United States Patent [19]

Dunks

[11] 4,004,630

[45] Jan. 25, 1977

[54] PROCESS FOR THE MANUFACTURE OF CAST IRON

[75] Inventor: Clifford Matthew Dunks, East Grinstead, England

[73] Assignee: Materials and Methods Limited, England

[22] Filed: Apr. 28, 1975

[21] Appl. No.: 571,621

[30] Foreign Application Priority Data

Apr. 29, 1974 United Kingdom ..... 18657/74

[52] U.S. Cl. ..... 164/57; 164/55

[51] Int. Cl.[2] ..... B22D 27/20

[58] Field of Search ..... 164/57, 55, 58

[56] References Cited

UNITED STATES PATENTS

| | | | |
|---|---|---|---|
| 3,703,922 | 11/1972 | Durks et al. | 164/57 |
| 3,746,078 | 7/1973 | Moore | 164/57 X |
| 3,851,700 | 12/1974 | McAfee et al. | 164/57 |

FOREIGN PATENTS OR APPLICATIONS

| | | |
|---|---|---|
| 1,364,837 | 8/1974 | United Kingdom |

*Primary Examiner*—Ronald J. Shore

*Attorney, Agent, or Firm*—Armstrong, Nikaido & Wegner

[57] ABSTRACT

The present invention provides a method for the production of modular graphite cast iron using a mould comprising a pouring bush, downsprue, gating and risering system, mould cavity and an intermediate chamber having a base and retaining walls positioned in the path of molten metal entering the mould and adapted to contain a nodularizing agent wherein the surface area of the base $A = (l/k)\ (W_T/T)\ (N_{nod}/W_T)$ where:

$l/k$ = constant $W_T/T$ = pouring rate of the metal $N_{nod}/W_T$ = concentration of nodularizing agent in the molten metals.

2 Claims, 1 Drawing Figure

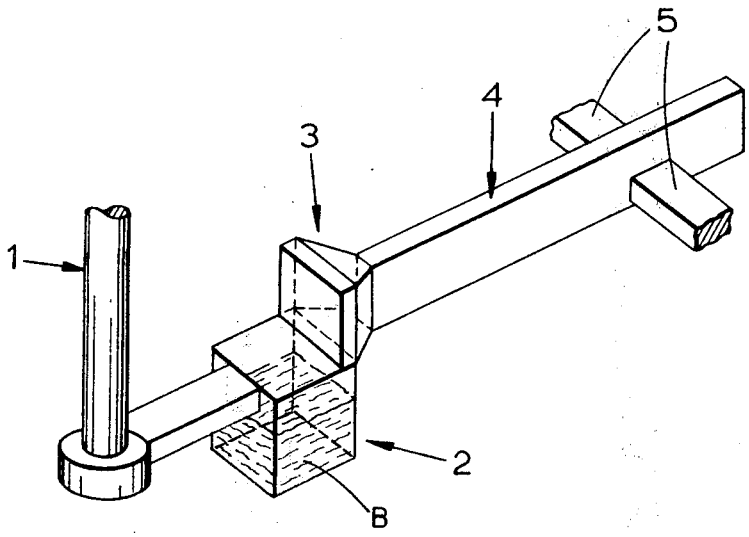
5
4
3
1
2
B

PROCESS FOR THE MANUFACTURE OF CAST IRON

BACKGROUND OF THE INVENTION

1. Field of the Invention

The present invention relates to an improved method for the production of nodular cast iron.

2. Description of the Prior Art

The carbon present in molten cast iron is normally present in the so-called flake form. If the metal is solidified in this form, however, the cast iron produced has properties which are inappropriate for certain uses, in particular, it has low hardness and tensile strength properties. It has, therefore, been known for some years to convert the flake to graphite to nodular form by treating the grey iron as it flows from the melting furnace or when it is received in the ladle from which the castings are to be poured.

The conversion is effected by a nodulariser introduced into the metal by means of a so-called nodularizing agent, for example, a nodularising alloy such as alloys of magnesium, calcium, lithium, strontium, barium, cerium, didynium, lanthanum and yttrium, which are readily oxidizable at the temperature of the molten cast iron or are volatile. The effect of these alloys, or nodularizing agents as they are generally termed herein, tends to disappear either during processing or subsequent standing and time taken in transferring the metal to the moulds, however, and as a result of this, there is a loss of strength properties as the carbon in the iron reverts to its original flake form. This effect is known as "fadin" and is a common problem in the industry.

A number of techniques have been applied to overcome this phenomenon, for example, by using a large quantity of nodularizing agent or by making a further addition of nodularizing agent during the pouring process. All of these techniques, however, constitute an increased cost in manufacture, since the nodularizing alloys are expensive and rarely are the added alloys more than 40% effective in relation to the amounts used. Furthermore, the use of excessive quantities of nodularizing alloys is deleterious in that it tends to give rise to the formation of oxides or silicates which become entrapped in the melt producing dirty castings or dross defects, and may also give rise to subsurface blow-holes and 'elephant skin'. The presence of excess nodularizer in the metal may also intensify contraction of the molten iron during solidification giving rise to shrinkage and other defects and consequent loss of physical properties, and since most of the alkali and earth metals used as nodularizers, e.g. cerium, didynium, lithium, magnesium and strontium are also carbide stabilizers, there is an inherent problem of over treatment leading to the production of hard and brittle castings and consequent loss of machinability and ductility. All of these problems, of course, lead to a loss of confidence in the dependability of the finished product, and in the case of modern production line castings, the reliability and reproducibility of the casting process are of considerable economic significance.

In U.S. Pat. No. 3,703,922, a process was described for the treatment of molten cast iron for conversion of the graphite (carbon) content to nodular or spheroidal form, which provides the basis for efficient, and above all, reliable production of nodular cast iron.

The basic concept of the invention described in U.S. Pat. No. 3,703,922 is that the nodularizer addition is effected within or adjacent the mould block and so close to the mould cavity itself. Accordingly, provision is made in the mould for a pre-formed chamber termed the 'intermediate chamber', in addition to the conventional pouring bush, downsprue, gating and risering systems required to correctly introduce the molten metal to the casting cavity itself. The intermediate chamber contains the nodularizing alloy, and may be located in any suitable position relative to the pouring bush, downsprue, gating and risering system or the casting cavity itself, in such a manner that the incoming molten metal comes into contact with the nodularizing agent before entering the mould cavity.

By this means, reaction of the nodularizing agent (alloy) with the molten metal commences uniformly and continues progressively until the mould cavity is completely filled, provided that the nodularizing agent is not, of course, exhausted before this stage is reached. As a result of this progressive reaction, the nodularizer is taken up into the metal at a uniform rate, and the whole batch of molten metal is thus uniformly treated leading to constant properties throughout the resultant casting. By siting the point of treatment close to, even adjacent to the mould cavity, the problem of fading is overcome, and since the reaction occurs when the molten metal covers the nodularizing agent, it occurs out of contact with the air, so that losses due to volatilization and oxidation are completely eliminated. Undesirable pyrotechnics, fume or turbulence is also avoided and greater economy of treatment is, therefore, achieved by this process.

A further advantage of the process in U.S. Pat. No. 3,703,922 is that it provides broadly a process in which it is possible to control quite precisely the amount of nodularizer that is required, for a given weight of metal, to convert the graphite entirely from flake to nodular form, while at the same time avoiding over treatment, with its attendant problems such as dross inclusions referred to earlier.

SUMMARY OF THE INVENTION

It is to this matter of controlling the process disclosed in U.S. Pat. No. 3,703,922 that the present invention is directed, and specifically the present invention provides a relationship of certain parameters through which the amount of nodularizing agent required relative to the degree of treatment of the cast metal which is to be effected may be readily established.

The present invention provides a method for the production of nodular graphite cast iron using a mould comprising a pouring bush, downsprue, gating and risering system, mould cavity and an intermediate chamber having a base and retaining walls positioned in the path of molten metal entering the mould and adapted to contain a nodularizing agent wherein the surface area of the base $A = K(W_T/T)(N_{nod}/W_T)$ where:

$k$ = constant $W_T/T$ = pouring rate of the metal $N_{nod}/W_T$ = concentration of nodularizing agent in the molten metals

BRIEF DESCRIPTION OF THE DRAWINGS

The FIGURE is a schematic of the apparatus of the present invention.

DESCRIPTION OF THE PREFERRED EMBODIMENT

The method of the present invention is based on the discovery that for any given nodularizing agent, the following relation holds true:

$$N_{nod} = kAT,$$

where $N_{nod}$ is the amount (by weight) of nodularizer (nodularizing constituent) taken up into the flowing molten metal:

$k$ is a constant; $A$ is the base area of the chamber; and $T$ is the total time during which the metal flows over the nodularizing agent.

If the weight of molten metal which flows in time T is $W_T$, then the concentration of the nodularizer in the cast metal, on a weight for weight basis will be:

$$N_{nod}/W_T = KAT/W_T,$$

which may be expressed as:

$$[\text{nodularizer}]_{\text{by weight fraction}} = k\ A\ (W_T/T^{-1}$$

The term $W_T/T$ represents the metal pouring rate, which is generally known, being fixed by other factors well known to those skilled in the art, while the overall amount of the nodularizer which it is desired should be taken up in the metal is also generally known, so that the only unknown in this equation is A, the base area of the intermediate chamber (or chambers) in the mould. Hence, by determining this latter parameter according to the relation:

$A = 1/k\ (W_T/T$[nodularizer] by weight fraction, or $A$ = (constant) × (pouring rate) × (desired nodularizer concentration), the exactly nodularizer treatment conditions will be obtained, and the production of sound, clean castings with the optimum structure and physical properties ensured. The technique also yields maximum recoveries from the nodularizing agent placed into the processing chamber: for example, the yield of magnesium in the cast metal from a 6% Mg nodularizing alloy has been found to be between 80 and 100% and for a 9% alloy between 70 and 90%, which is twice the yield possible from normal processing methods.

The formula for calculating the base area of the intermediate chamber in the mould is derived as a result of the examination of the interpendence of the three parameters appearing in the formula, viz. the concentration of the nodularizer in the metal as cast, the pouring rate and the area of the chamber. In carrying out a seris of test castings using various pouring rates and chamber areas and observing the resultant concentration of nodularizer in the cast metal, it has been found that by plotting a graph of the metal flow rate divided by the chamber area against nodularizing agent content in the cast metal, a straight line graph was obtained. The metal flow rate divided by the chamber area is termed the alloy solution factor.

There are certain factors which are known to affect the amount of nodularizer taken up from the nodularizing agent into the metal flowing past the alloy. These factors include, for example, temperature of the metal, as well as the physical and chemical properties of the nodularizing alloy itself. By holding these factors constant in any series of tests, the interrelationship of the three variables in the equation is found to be the same and is defined by the equation.

The factors which affect the amount of nodularizer taken up from the nodularizing alloy affect the value of the constant k. The manner of determining the constant k will be discussed below.

The present invention accordingly provides a method for the production of castings consisting of iron in which the graphite present is in the form of nodular or spheroidal particles, wherein molten iron, in which the graphite is in flake form, is introduced into a casting mould cavity by way of one or more intermediate chambers situated within the mould block, said chamber or chambers each comprising at least a base and retaining walls, and containing a nodularizing agent, the area of the base or bases of the chamber or chambers being made equal to (constant, as herein defined) × (metal pouring rate) × (overall concentration of the nodularizer in the cast metal, expressed on a weight basis as a proportion of the weight of the cast metal).

The mould used in the method of the invention comprises a pouring bush, downsprue, gating and risering systems and a casting mould cavity, wherein there is also provided chamber or chambers having at least a base and retaining walls associated with the mould and arranged in the path of the molten metal entering the mould, which chamber is adapted to contain a nodularizing agent and is dimensioned to give a surface area for the base thereof which is equal to (constant) × (metal pouring rate) × (overall concentration of the nodularizer in the cast metal, expressed as a proportion of the weight of the metal cast).

By the overall concentration of the nodularizer in the metal as cast, is meant the total amount of nodularizer which enters the metal from the nodularizing agent as the metal flows past the agent. This amount, which is readily calculable from the known characteristics of the base metal and the desired degree of nodularizer effect in the cast metal, is comprised of an amount of nodularizer required to effect desulphurization of the metal and an amount required for nodularization of the graphite in the metal. The amount of nodularizing agent is thus determined by the desired characteristics of the casting. Having once determined, therefore, what level of nodularizer is required in the after treated metal, it is possible, by application of the relationship described previously, to establish the requisite chamber dimensions so as to reproducibly and reliably obtain castings of the same properties and quality even where the characteristics of the pre-treated metal may vary from batch to batch. Positive control of the product characteristics is thus achieved, and by exactly fitting the quantity of nodularizing agent present in the chamber to the required level of nodularizer uptake into the metal, a considerable economy in the use of the expensive nodularizing agent is achieved. This economy is over and above that referred to previously as being generally attained by the application of the intermediate chamber technique as disclosed in U.S. Pat. No. 3,703,922, and it does illustrate how the potential for control of the latter process can be realized, in fact, to give a specifically high attainment and a high degree of predictability in the case of the controlled process of the present invention.

As an example, complete conversion of the graphite from flake to perfect spheroidal form has been achieved with as little as 0.15 percent of nodularizing alloy used in accordance with the invention, whereas with any of the conventional techniques previously employed, it would have been necessary to use at least 0.75 percent of nodularizing agent. This represents an important saving, since these alloys are the most costly ingredients used in the manufacture of nodular iron, and as an example, nodularization processing costs have been reduced by more than 50% in some cases. Yields of magnesium in the cast metal of 80 to 100% have been achieved from a 6% Mg nodularizing alloy and of 70 to 90% from a 9% Mg alloy with the present process.

As regards the constant which appears in the equation described, this is dependent on a number of parameters and is thus to be regarded as a true constant only under the constraint of certain process limitations. The constant may be viewed to some extent as an efficiency factor, expressing the efficiency of transfer of the nodularizer in the nodularizing agent to the metal as it flows over the agent, and the retention therein up to the completion of the casting process. Accordingly, it may be seen that the constant will be dependent upon both physical form and the chemical composition of the nodularizing agent.

As to the physical form, the agent may be used in lump form, as a crushed aggregate, in powder form or as an extruded or compacted/bonded shape, while from the composition point of view, the content of the nodularizer itself in the agent will be significant. The efficiency of nodularizer takeup may be also affected by the presence in the agent of a suppression element. For example, with magnesium alloy nodularizing agents, the presence of calcium in certain critical amounts leads to a lower efficiency in the utilization of the agent, the most suitable alloys being those which have a magnesium/calcium ratio of not less than 9:1.

Apart from these factors, the temperature of the casting metal may also be significant, though it has been found that there is no significant variation within a range of 1425° + 50° C for a given nodularizer.

Apart from the area of the base of the chamber, other aspects of the chamber dimensions appear not to be important in determining the area to be fixed for the chamber base when carrying out production casting. The constant for given conditions of metal temperature, physical and chemical make-up of the nodularizing agent can be obtained by carrying out test castings and checking the products to determine the actual nodularizer content. Using various pouring rates and/or chamber areas a series of results will give a working value for the efficiency constant under the test conditions which will be chosen, of course, to simulate operational conditions in regard to the nature of the nodularizing agent to be used and the metal temperature. Thereafter use of a determined constant in conjunction with (known) parameters of metal pouring rates (dependent on casting size and complexity) and base metal properties, will establish the necessary size of the nodularizing agent (intermediate) chamber which should be provided.

As an example, for magnesium alloy nodularizing agents with a grading in the range of 0.5 to 4mm, the following constants have been determined:

$k$ (6% Mg alloy) = 0.032 lb./in$^2$ sec.
$k$ (9% Mg alloy) = 0.048 lb/in$^2$ sec.

based on pouring rates measured in lbs/sec and chamber areas measured in square inches.

Where it is desired to form complex castings, it may be necessary to have more than one inlet for molten metal into the casting cavity, in which case intermediate chambers may be associated with any or all of the systems conveying the molten metal to the casting cavity, for example, an intermediate chamber can be associated with each runner bar. In these cases the area which is to be set for the chamber area A is calculated as the sum of the areas of all of the individual chambers.

Reference is now made to the FIGURE in which is shown a view of an embodiment of a mould system according to the invention. In this embodiment, molten metal enters the mould system by way of a pouring bush, not shown, downsprue 1 and into the reaction chamber 2 having a base B, which contains the nodularizing agent. The gate 3 regulates the outflow of metal from the chamber, so ensuring a sufficient residence time for the metal in the chamber for reaction with the nodularizing agent therein. From the gate the molten metal flows via a runner 4 and ingates, e.g. 5 to the rest of the system comprising a riser and the mould cavity proper, (not shown). Thus as molten iron passes into the casting mould, it contacts the nodularizing additive in the intermediate (reaction) chamber 2 and the graphite in the iron is converted into nodular or spheroidal form.

The present invention is further illustrated by the following Examples.

EXAMPLE 1

With a certain sample of base metal for casting, it was calculated that the total magnesium required to nodularize the graphite in the metal of 0.04%. If a 6% Mg nodularizing alloy is being used for which $k = 0.032$ as indicated previously, then according to the formula:

$$\text{chamber area} = \frac{0.04}{0.032} \times \frac{W}{t}$$

For a pouring rate of the metal of 10 pounds per second, e.g. 100 pounds of liquid metal in 10 seconds, $W/_t = 10$ and hence:

$$\text{Solution area} = \frac{0.04 \times 10}{0.032} = 12.5 \text{ sq. inches}$$

This area will yield 0.04% Mg content in the metal in a uniform manner throughout the cast piece. The processing chamber would, therefore, require a cross sectional area of 12.5 sq. inches.

EXAMPLE 2

If, because of metal compositional problems or if there was insufficient area available to permit the positioning of a chamber of the area as calculated in Example 1, then an alloy of increased concentration can be used such as a 9% Mg content alloy, for which constant $k = 0.048$. If a similar magnesium contact to that in Example 1 was required, the calculation would then become (taking the same pouring rate):

$$\text{chamber area} = \frac{0.04 \times 10}{0.048}$$

$$= 8.35 \text{ sq. inch}$$

The area of the processing chamber required for the nodularizing alloy will be less with increasing Mg concentration in the alloy and the converse applies for low alloy concentration, as is clearly apparent from the relationship expressed earlier.

This effect can be applied in the case of a given casting requiring higher than routine magnesium concentration for the purpose of improved physical properties, or because of increased or lengthened solidification time due to heavy sections.

EXAMPLE 3

A casting was required to be formed having metal sections 3 inches thick. It was calculated that a retained Mg content of 0.06% was necessary to maintain graphite in the spheroidal form. It was also necessary to pour the casting at a slow rate to avoid excessive shrinkage, a rate of 250 lbs in 50 secs being used. The 6% Mg alloy as used above was selected for the processing. Then, $$\text{required chamber area} = \frac{Mg_t \times W}{k \times t}$$

$$= \frac{0.06 \times 250}{0.032 \times 50}$$

$$= 9.3 \text{ sq. inches}$$

To obtain the overall chamber dimensions, it is necessary to calculate the volume of alloy required. Assuming a 100% efficiency for the alloy, the quantity of alloy required to process 250 lbs of metal is:

$$\frac{0.06}{100} \times 250 \times \frac{100}{6} = 2.5 \text{ lb}$$

$$= 40 \text{ oz}$$

The alloy density being 1.2 oz/cubic inch, give:

Volume in cubic inches = 40/1.2 = 33 cubic inches

Hence, chamber depth = 33/9.3 = 3.55 inches

The complete processing chamber dimensions are, therefore, 3.1 × 3 × 3.55 inches.

EXAMPLE 4

Having established the relationship between the chamber (processing) area in square inches and the metal treatment rate in pounds per second, a table similar to the one below can be calculated for the dissolved Mg content range required by any given casting plant.

From this table the required chamber areas can be obtained for any given treatment flow rate, to yield the desired magnesium content in the processed metal.

Selection of reaction chamber size according to pouring rate and retained magnesium content in cast metal

| Treatment of flow rate lb/sec | Chamber Area (sq. ins) required to yield Mg content in cast metal of: 0.035% | 0.032% | 0.028% |
|---|---|---|---|
| 2 | 2.22 | 2 | 1.82 |
| 4 | 4.44 | 4 | 3.64 |
| 6 | 6.66 | 6 | 5.45 |
| 8 | 8.89 | 8 | 7.27 |
| 10 | 11.11 | 10 | 9.09 |
| 12 | 13.33 | 12 | 10.91 |
| 14 | 15.56 | 14 | 12.73 |
| 16 | 17.78 | 16 | 14.55 |
| 18 | 20.00 | 18 | 16.36 |
| 20 | 22.22 | 20 | 18.18 |
| 22 | 24.44 | 22 | 20.00 |
| 24 | 26.67 | 24 | 21.82 |
| 26 | 28.89 | 26 | 23.64 |
| 28 | 31.11 | 28 | 25.45 |
| 30 | 33.33 | 30 | 27.27 |

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all changes which come within the meaning and range of equivalency of the claims are, therefore, to be embraced therein.

I claim:

1. A method for the production of the nodular graphite cast iron castings in a mold into which molten grey iron is introduced, said method comprising the steps of:

a. determining the required concentration of a nodularizing agent required to nodularize said molten grey iron;

b. selecting a nodularizing alloy having a predetermined percentage of nodularizing agent therein and a predetermined efficiency factor $k$ which is a function of the solubility of the nodularizing alloy in the molten grey iron;

c. placing the nodularizing alloy into at least one intermediate chamber in said mold, said intermediate chamber having a base area A wherein $$A = 1/k\ (W_T/T)\ (N_{nod}/W_T)$$

where $W_T/T$ = pouring rate of the molten metal into the mold $N_{nod}/W_T$ = required concentration of nodularizing agent d. pouring said molten grey iron into said mold wherein said nodularizing agent is taken into solution in said molten grey iron, as said molten metal passes over the nodularizing agent in said intermediate chamber, whereby the graphite in said molten grey iron is converted to a nodular form such that a nodular cast iron casting is formed.

2. The method of claim 1 wherein said at least one intermediate chamber comprises at least two intermediate chambers and the total base area of said at least two intermediate chamber is A.

* * * * *